US005347242A

United States Patent [19]

Shimano et al.

[11] Patent Number: 5,347,242

[45] Date of Patent: Sep. 13, 1994

[54] SUPERCONDUCTING ACCELERATING TUBE COMPRISED OF HALF-CELLS CONNECTED BY RING SHAPED ELEMENTS

[75] Inventors: Takashi Shimano; Misao Sakano; Shinichi Mukoyama, all of Yokohama, Japan

[73] Assignee: The Furukawa Electric Co., Ltd., Tokyo, Japan

[21] Appl. No.: 927,277

[22] PCT Filed: Jan. 24, 1991

[86] PCT No.: PCT/JP91/00073

§ 371 Date: Sep. 21, 1992

§ 102(e) Date: Sep. 21, 1992

[87] PCT Pub. No.: W092/13434

PCT Pub. Date: Aug. 6, 1992

[51] Int. Cl.[5] ..... H05H 9/00; H01B 12/06

[52] U.S. Cl. ..... 333/99 S; 315/5.41; 505/866

[58] Field of Search ..... 333/99 S; 315/5.41, 315/5.42; 313/359.1, 360.1; 328/233, 227; 505/866, 854

[56] References Cited

U.S. PATENT DOCUMENTS

| | | | |
|---|---|---|---|
| 3,514,662 | 5/1970 | Eldredge | 315/5.41 X |
| 3,953,758 | 4/1976 | Tran | 315/5.41 X |
| 4,765,055 | 8/1988 | Ozaki et al. | 29/599 |
| 5,239,157 | 8/1993 | Sakano et al. | 315/3.5 X |

FOREIGN PATENT DOCUMENTS

| | | | |
|---|---|---|---|
| 379224 | 7/1990 | European Pat. Off. | 328/233 |
| 62-181508 | 8/1987 | Japan . | |
| 1-124700 | 8/1989 | Japan . | |
| 1-259601 | 10/1989 | Japan . | |
| 159101 | 6/1990 | Japan | 333/99 S |

OTHER PUBLICATIONS

Hillenbrand, B. et al.; "Superconducting $Nb_3SN$ cavities with high microwave quality"; *IEEE Transactions on Magentics*; vol. MAG-13, No. 1; Jan. 1977; pp. 491-495.

Heinrichs & Weingarten; "An RF Contact for Superconducting Cavities"; *Nuclear Instruments and Methods*; vol. 171, No. 1; Apr. 1, 1980; pp. 185-188.

*Primary Examiner*—Benny T. Lee

*Attorney, Agent, or Firm*—Frishauf, Holtz, Goodman & Woodward

[57] ABSTRACT

A superconducting accelerating tube which is constructed by welding and connecting a plurality of half cells (11) formed of superconductor material in a dish form having a substantially constant wall thickness of the material, and having a small-diameter portion (11*a*) and a large-diameter portion (11*b*) and in which the shell diameter periodically varies. The half cells (11) are welded together via ring-shaped connecting members (12) formed of superconducting material and disposed between the small-diameter portions (11*a*), and the half cell (11) and connecting member (12) are formed of Nb.

20 Claims, 5 Drawing Sheets

SUPERCONDUCTING ACCELERATING TUBE COMPRISED OF HALF-CELLS CONNECTED BY RING SHAPED ELEMENTS

TECHNICAL FIELD

This invention relates to a microwave charged particle accelerating tube formed of a superconductor.

BACKGROUND ART

In an accelerator using a high frequency electric field to accelerate charged particles, an accelerating tube is used as a device for generating the high-frequency accelerating electric field. Such an accelerating tube is preferable to accelerate the charged particles to a higher energy level while using less microwave power. It is said that the accelerating tube formed of superconductor material may serve the above purpose since the high-Frequency resistance on the tube wall thereof is small.

The conventional superconducting accelerating tube (FIG. 9) is constructed by working a hollow disk of superconducting material such as Nb into a half cell 1 in a dish form having a substantially constant thickness and having a small-diameter portion 2 and a large-diameter portion 3 which are open at the end portion thereof as shown in FIGS. 7 and 8 and then welding the half cells together into a tubular form. That is, the superconducting accelerating tube is constructed by arranging a plurality of half cells 1 with the small-diameter portion 2 and large-diameter portion 3 of each half cell set to face the small-diameter portion 2 and large-diameter portion 3 of adjacent half cells as shown in FIG. 9 and then respectively welding the small-diameter portion 2 and large-diameter portion 3 of each half cell to the small-diameter portion 2 and large-diameter portion 3 the adjacent half cells by use of an electron beam, for example, so as to connect the half cells.

With the above superconducting accelerating tube, it is impossible for a welding machine to approach a portion near the small-diameter portion 2 having the smallest diameter from the inside thereof since the diameter thereof is small. Therefore, when a plurality of half cells 1 are connected together by welding, it is required to weld the small-diameter portions 2 from the external surface side. However, since the wall thickness of the material of the half cell 1 is small, weld beads may easily occur on the internal surface side when the small-diameter portions 2 are welded together from the external surface side.

Since the electric field is strong near the small-diameter portion 2 of the superconducting accelerating tube, discharge may occur if the weld beads are left behind on the internal surface side. This is not preferable. Therefore, in the superconducting accelerating tube, smooth abrasion of the inner portion of the small-diameter portion 2, or the like, must be carried out after a plurality of half cells 1 are welded together.

Therefore, the half cell 1 is required to have a wall thickness (1 mm) larger than a certain value in order to make it possible to easily effect the welding operation, take a sufficiently large abrading margin, etc. after the welding operation, and have a sufficiently large strength which may prevent occurrence of deformation during the abrading process.

The characteristic of the superconducting accelerating tube largely depends on the heat conductivity thereof, and it is necessary to attain high heat conductivity and enhance thee cooling efficiency in order to store a large amount of energy.

That is, the superconductor has a high-frequency resistance so that a large amount of heat will be generated on the surface of the superconductor particularly in an electromagnetic resonator such as an accelerating Lube for storing a large amount of energy. Therefore, unless the heat is sufficiently quickly dissipated, the temperature of the superconductor rises and the superconductivity thereof will be destroyed before long.

Since the high-frequency excitation mode ordinarily used in the accelerating tube is $TM_{010}$, the largest current will flow in a portion near the large-diameter portion 3 having the largest diameter and the smallest electric field. In contrast, in the small-diameter portion 2 having the smallest diameter, the electric field is high but the current is small. Since a large amount of heat may be generated in the large-diameter portion 3 in which a large current flows, it is necessary to enhance the cooling efficiency of the large-diameter portion 3.

As described above, in order to store a large amount of energy, it is necessary to enhance the heat conductivity of the superconducting accelerating tube and thus enhance the cooling efficiency. In order to attain this, it is preferable to enhance the cooling efficiency by reducing the wall thickness of the material of the superconducting accelerating tube.

However, in a case where the superconducting accelerating tube is constructed by welding as in the prior art, the possible degree of reduction of the wall thickness is limited.

As one of the prior art methods, there is used a method of enhancing the heat conductivity by enhancing the purity of the superconductor material such as Nb which constitutes the half cell 1 to increase the residual resistance ratio RRR. However, the method off increasing the RRR also has a limitation and it cannot be said that the present method is sufficiently good.

Further, as another prior art method, a half cell obtained by plating a superconductor material on a good heat conductor such as copper or aluminum has been developed. However, since the thickness of the superconductor material of the half cell is small, the plated superconductors cannot be welded together and therefore it is necessary to plate the superconductor on the joined portion after the half cells are joined.

This invention has been made in view of the above, and an object thereof is to provide a superconducting accelerating tube in which the wall thickness can be reduced to enhance the cooling efficiency and the half cells can be easily welded together.

SUMMARY OF THE INVENTION

In order to attain the above object, according to this invention, a superconducting accelerating tube is constructed by welding. The invention comprises connecting a plurality of half cells formed of superconductor material in a dish form having a substantially constant thickness and having a small-diameter portion and a large-diameter portion and in which the shell diameter periodically varies. The half cells are welded together via ring-shaped connecting members formed of superconducting material and disposed between the small-diameter portions.

The superconducting accelerating tube of this invention is constructed in a tubular form by disposing connecting members between the half cells and welding a plurality of dish-shaped half cells which are each formed of superconductor material and have small- and large-diameter portions on both sides.

With the above construction, the inner diameter of the small-diameter portion of the half cell is increased by an amount: corresponding to the connecting member, and the connecting member, and the half cell can be welded together from the internal side. Therefore, the welded surface can be made smooth and the post-treatment such as the abrading operation is not necessary.

Further, the half cell and connecting member utilize niobium (Nb) as a superconducting material.

Preferably, the half cell and connecting member have a layer of $Nb_3Sn$ or NbN formed on the internal surface of Nb. When such a layer is formed, it is possible that a higher accelerating electric field can be attained since the critical magnetic field is enhanced.

For example, when a layer of $Nb_3Sn$ is formed on the inner surface of the half cell, Sn is plated on the inner surface of the half cell formed of Nb and is then subjected to a thermal oxidation process so as to form a layer of $Nb_3Sn$.

The wall thickness of the superconducting accelerating tube is limited by the wall thickness oil the small-diameter portion off the half cell, but this invention, the wall thickness of the small-diameter portion can be reduced by providing the connecting member. Therefore, the wall thickness of the large-diameter portion in which the cooling efficiency is most severely required can be reduced, making it possible to enhance the cooling efficiency.

In this case, the wall thickness (mm) of the half cell constituting the superconducting accelerating tube is preferably set to be equal to or more than 1/800 of the inner diameter (mm) of the large-diameter portion, and more preferably, it is set to be equal to or more than 0.1 mm and equal to or less than 1 mm.

Generally, in a superconducting accelerating tube, a relation approximately expressed by the following equation (1) is set up between the resonant frequency f (GHz) and the diameter d (mm) of a large-diameter portion corresponding to the large-diameter portion of the half cell.

$$f \times d = 250 \quad (1)$$

However, in the superconducting accelerating tube of this invention, it is difficult to work the connecting member so as to make the thickness thereof equal to or less than 5 mm. For this reason, if the wall thickness of the half cell is set to be equal to or less than 0.1 mm when a superconducting accelerating tube in which the diameter of the large-diameter portion is equal to or less than 80 mm is used, the weight of the connecting member cannot be supported and proper welding cannot be attained. On the other hand, when the wall thickness of the half cell has exceeded 1 mm, the heat conductivity is lowered and the cooling efficiency of the superconducting accelerating tube is reduced, and this is not preferable.

DETAILED DESCRIPTION

Figure 1:
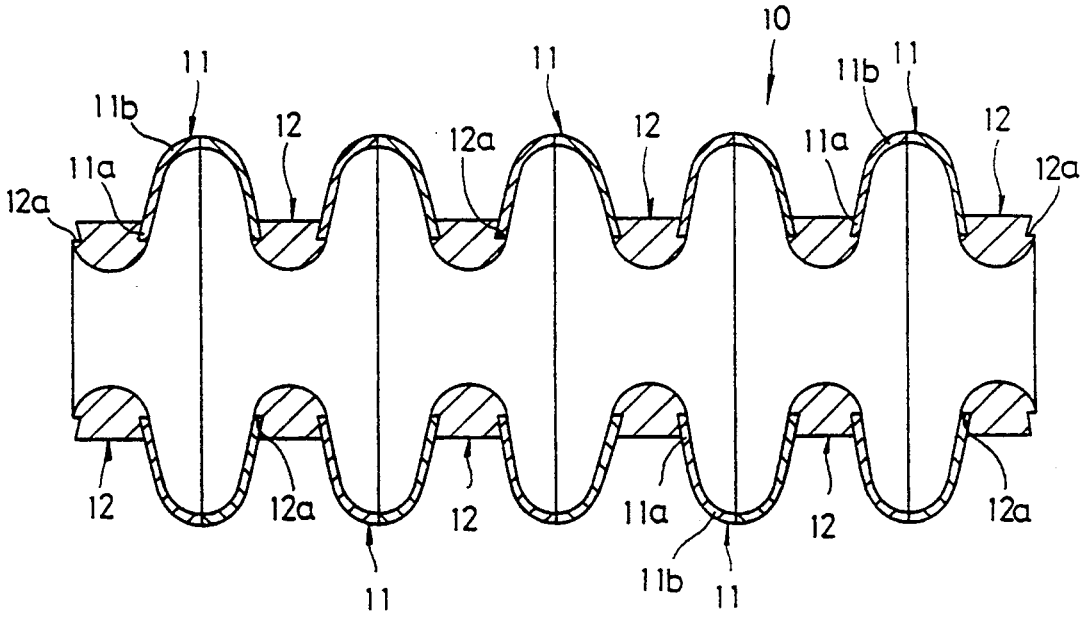
FIG. 1 is a cross sectional front view of a superconducting accelerating tube of this invention.

There will now be described an embodiment of this invention with reference to FIGS. 1 to 6. In all of the drawing Figures, the same reference numerals designate the same respective elements.

Figure 2:
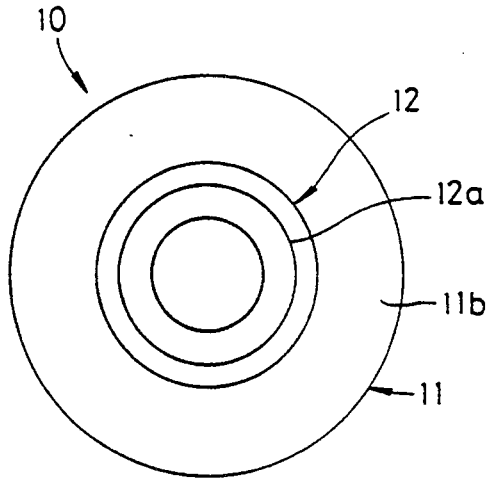
FIG. 2 is a left side view of the superconducting accelerating tube shown in FIG. 1.

A superconducting accelerating tube 10 is formed by welding a plurality of half cells 11 into a tubular form whose shell diameter periodically varies as shown in FIGS. 1 and 2 with connecting members 12 disposed between the half cells 11.

The half cell 11 is formed by subjecting a hollow disk formed of Nb to a drawing process, for example, so as to form the disk into a dish-shaped member having a small-diameter portion 11*a* (see FIG. 1) and a large-diameter portion 11*b* which are open at the respective end portions and having a substantially constant wall thickness as shown in time drawing.

Figure 3:
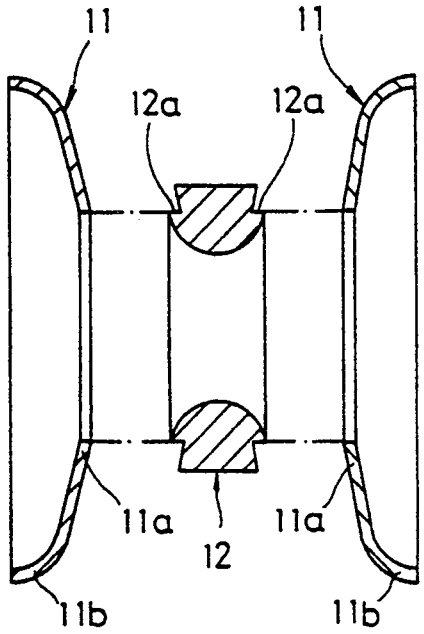
FIGS. 3 to 5 are cross sectional front views showing a process manufacturing a superconducting accelerating tube of this invention.

The connecting member 12 is a ring-shaped member formed of Nb and, as shown in FIGS. 1–3, has stepped portions 12*a* (FIGS. 1, 2 and 3) which are formed on the outer periphery thereof to abut against the front portions off the small-diameter portions 11*a* (FIGS. 1 and 3) of the half cells 11. The connecting member 12 is used as a small diameter portion of the accelerating tube 10 when the lair cells 11 are welded together to form the superconducting accelerating tube 10.

The superconducting accelerating tube 10 is manufactured as follows.

First, as shown in FIG. 3, the connecting members 12 are disposed between the small -diameter portions 11*a* of the half cells 11.

Figure 4:
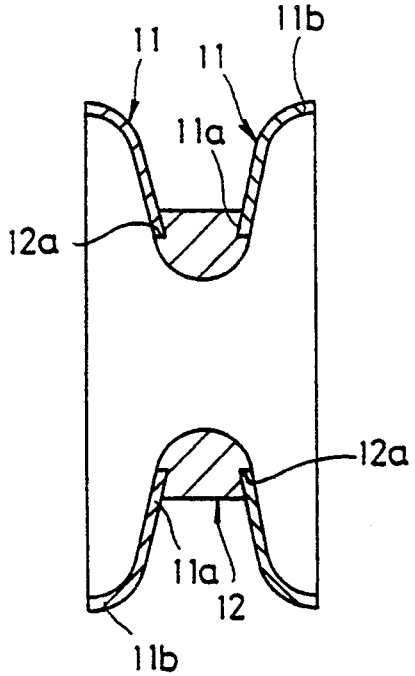

Next, as shown in FIG. 4, the front end of the small-diameter portion 11*a* of each of the half cell 11 is abutted against the stepped portion 12*a* of a corresponding one of the connecting members 12, and the small-diameter portion 11*a* is welded to the connecting member 12 from the inner surface side of a portion beside the large-diameter portion 11*b* (see also FIG. 3) so as to form a superconducting accelerating tube unit.

Figure 5:
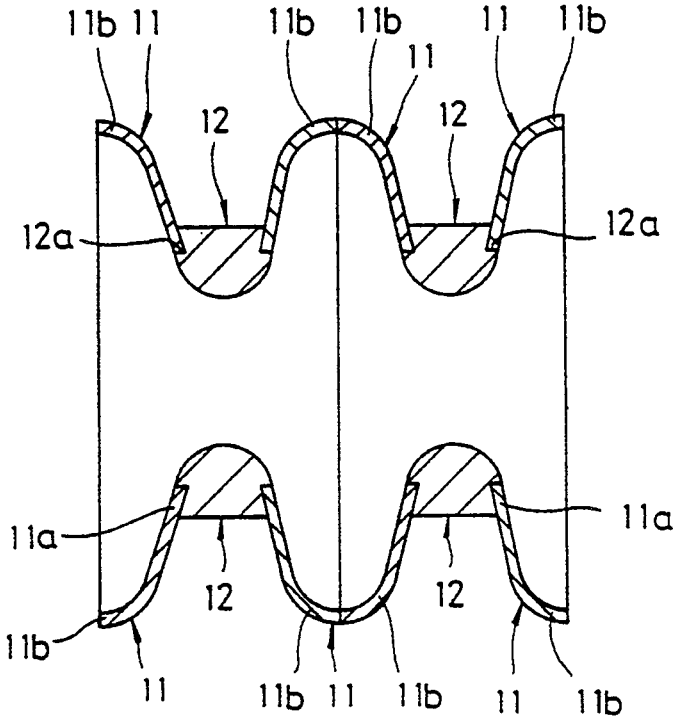
Figure 7:
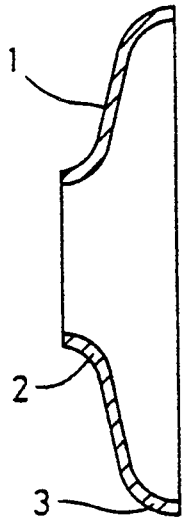
FIG. 7 PRIOR ART
FIG. 7 is a cross sectional front view of a half cell used in the conventional superconducting accelerating tube.

Next, as shown in FIG. 5, two superconducting accelerating tube units shown in FIG. 4 were set with the large-diameter portions 11*b* of the half cells 11 facing each other and then welded together. Elements 11*a*, 12 and 12*a*, as seen in FIG. 5, are the same as shown in FIGS. 1–4.

Likewise, a plurality of the superconducting accelerating tube units were welded and connected together in the same manner to form the superconducting accelerating tube 10 shown in FIG. 1.

In this case, since the diameter of the small-diameter portion 11*a* of the half cell 11 was increased by an amount corresponding to the connecting member 12, the half cell 11 and the connecting member 12 could be easily welded together from the internal side and a smooth welded surface could be obtained. Further, since the connecting member 12 was disposed on the external side of the small-diameter portion 11*a*, the welded portion could be finished without permitting weld beads or the like to protrude to the exterior.

Further, since the small-diameter portion 11*a* of the half cell 11 was reinforced by the connecting member 12, the wall thickness of the half cell 11 could be reduced as a whole. Therefore, the wall thickness of the half cell 11 can be reduced and the cooling efficiency of the superconducting accelerating tube 10 can be enhanced.

In this case, the superconducting accelerating tube 10 can be freely formed with a desired length by changing the number of the superconducting accelerating tube units shown in FIG. 4.

Figure 6:
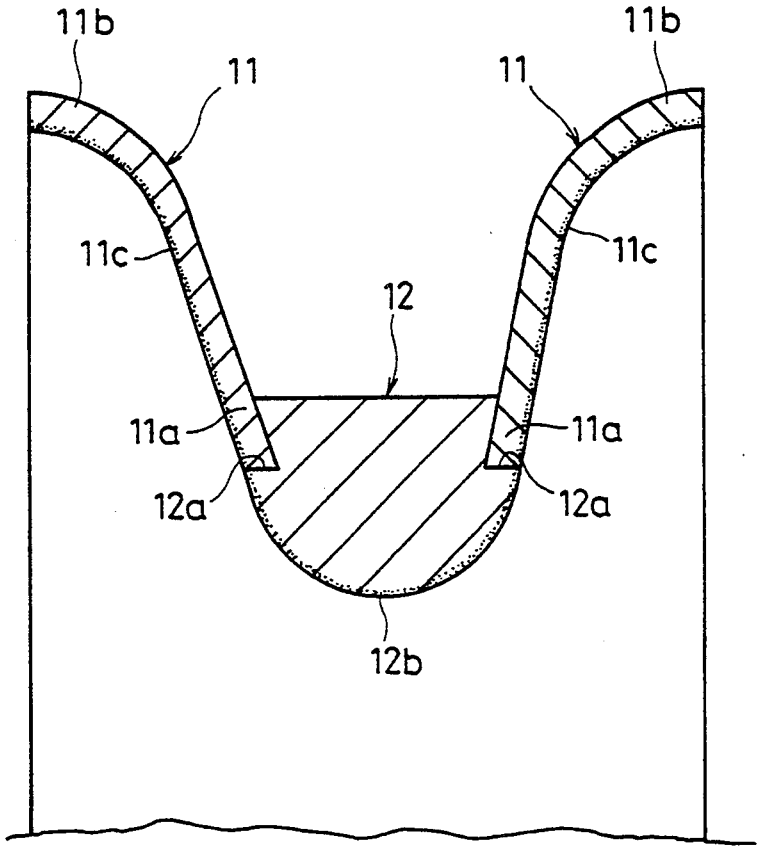
FIG. 6 is an enlarged cross sectional view of a portion of the tube of FIG. 5, showing a layer of $Nb_3Sn$ or NbN on an inner surface of a half cell.
Figure 8:
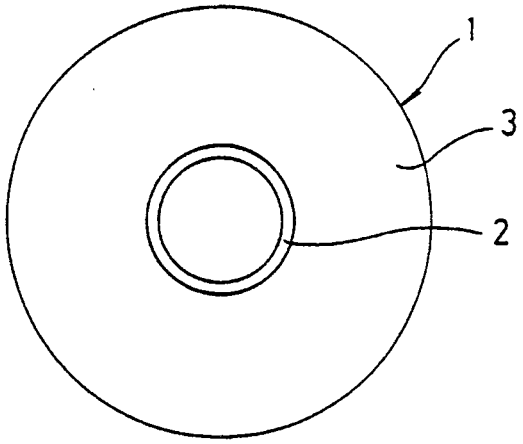
FIG. 8 PRIOR ART
FIG. 8 is a left side view of the half cell shown in FIG. 7.
Figure 9:
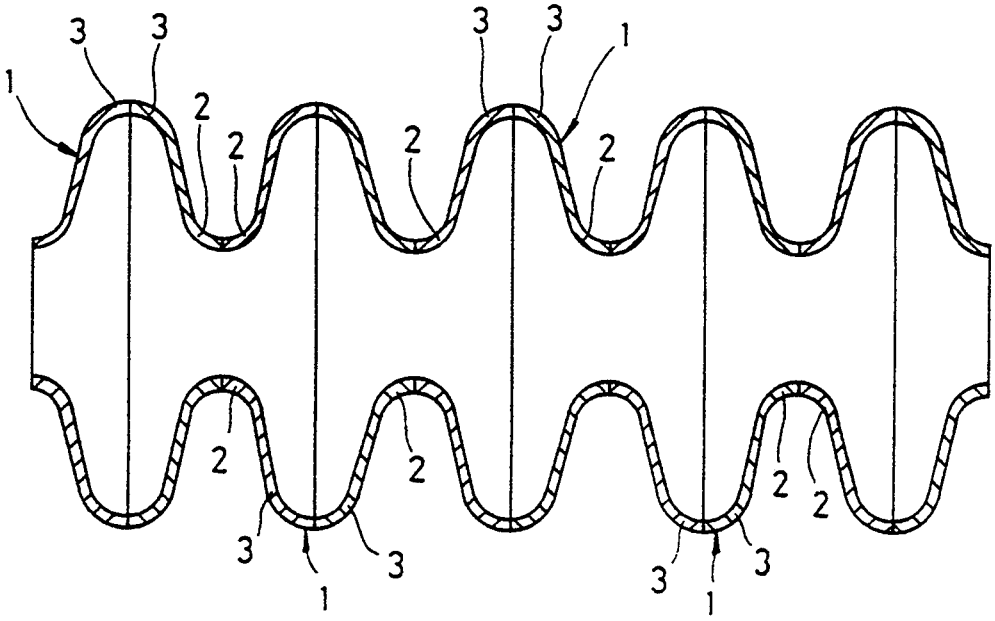
FIG. 9 PRIOR ART
FIG. 9 is a cross sectional front view showing a superconducting accelerating tube constructed by welding and connecting a plurality of half cells shown in FIGS. 7 and 8.

Further, as schematically shown in FIG. 6, when the half cells 11 and the connecting members 12 constituting the superconducting accelerating tube 10 are Formed to have a layer 11*c*, 12*b*, respectively of $Nb_3Sn$ or NbN formed on the internal surface of Nb, it becomes possible that a higher accelerating electric field can be attained since the critical magnetic field is enhanced. The other reference numerals in FIG. 6 designate the same elements as described above with reference to FIGS. 1–5.

As the design specification of the superconducting accelerating tube of this invention, the diameter of the large-diameter portion is set to 80 to 90 mm, the diameter of the small-diameter portion is set to approx. 10 to 20 mm, and the wall thickness of the material of the half cell 11 is set to 0.1 to 1 mm according to the equation (1) expressing the relation between the resonance frequency and the diameter of the large-diameter portion in a case where an accelerating tube having a resonance frequency of 3 GHz is used.

In the conventional accelerating tube, the wall thickness of the half cell must be set equal to or larger than 1 mm, and it will be easily understood that the cooling efficiency of the large-diameter portion is enhanced by use of the superconducting accelerating tube of this invention.

Further, when the wall thickness of the half cell 11 is made less than 0.1 mm, the mechanical strength of the welded portion of the resulting superconducting accelerating tube is lowered so that the wall thickness cannot be made less than 0.1 mm.

Further, when the resonant frequency is changed, the diameter of the large-diameter portion is set to approx. 500 mm according to the equation (1) when an accelerating tube of 500 MHz is used, for example. Therefore, the wall thickness of the half cell i s set to six times that set in the case of 3 GHz, that is, it is set equal to or more than 0.6 mm.

Possibility of Industrial Application

According to a superconducting accelerating tube of this invention, the half cells are welded together at the small-diameter portions with the ring-shaped connecting members of superconductor disposed therebetween and therefore the small-diameter portions are reinforced by the connecting members.

Therefore, according to the superconducting accelerating tube, since the board thickness of the half cell can be reduced as a whole, time cooling efficiency can be enhanced so that a high accelerating electric field can be obtained with less microwave power, thereby providing advantages that the cooling-down cost can be reduced and the area of for installation of a cooling device can be reduced.

We claim:

1. A superconducting accelerating tube comprising:

a plurality of half cells, each half cell being comprised of a superconductor material is a dish form and each half cell having a substantially constant thickness;

each half cell having a generally circular periphery and having a small-diameter portion and a large-diameter portion, and wherein each half cell has a shell diameter which varies between the small-diameter portion and the large-diameter portion;

the respective large-diameter portions of adjacent half cells being connected together; and a respective ring-shaped connecting member, comprised of a superconductor material, interposed between said small-diameter portions of adjacent half cells, said adjacent half cells each having a welded connection to portions of said ring-shaped connecting members such that said adjacent half cells are connected together via said respective ring-shaped connecting member with said ring-shaped connecting member disposed between said small-diameter portions.

2. The superconducting accelerating tube of claim 1, wherein said superconductor material of said respective ring-shaped connecting member is Nb.

3. The superconducting accelerating tube of claim 2, wherein said respective ring-shaped connecting member has a layer of $Nb_3Sn$ on an internal surface thereof.

4. The superconducting accelerating tube of claim 2, wherein said respective ring-shaped connecting member has a layer of NbN on an internal surface thereof.

5. The superconducting accelerating tube of claim 1, wherein the material of each of said half cells has a thickness in a range between 0.1 mm and 1 mm.

6. The superconducting accelerating tube of claim 1, wherein said small-diameter portions of said adjacent cells are connected by the respective welded connection to opposite side portions of said ring-shaped connecting members.

7. The superconducting accelerating tube of claim 1, wherein said large-diameter portion of adjacent half cells are connected together via a respective welded connection.

8. The superconducting accelerating tube of claim 1, wherein the large-diameter portion of each of said half cells has an inner diameter, and the material of each of said half cells has a thickness of not less than 1/800 of the inner diameter of the large-diameter portion thereof.

9. The superconducting accelerating tube of claim 1, wherein said superconductor material of each of said half cells is Nb.

10. The superconducting accelerating tube of claim 9, wherein each of said half cells has a layer of $Nb_3Sn$ on an internal surface thereof.

11. The superconducting accelerating tube of claim 10, wherein the large-diameter portion of each of said half cells has an inner diameter, and the material of each of said half cells has a thickness of not less than 1/800 of the inner diameter of the large-diameter portion thereof.

12. The superconducting accelerating tube of claim 10, wherein said superconductor material of said respective ring-shaped connecting member is Nb.

13. The superconducting accelerating tube of claim 10, wherein the material of each of said half cells has a thickness in a range between 0.1 mm and 1 mm.

14. The superconducting accelerating tube of claim 9, wherein each of said half cells has a layer of NbN on an internal surface thereof.

15. The superconducting accelerating tube of claim 14, wherein said superconductor material of said respective ring-shaped connecting member is Nb.

16. The superconducting accelerating tube of claim 14, wherein the large-diameter portion of each of said half cells has an inner diameter, and the material of each of said half cells has a thickness of not less than 1/800 of the inner diameter of the large-diameter portion thereof.

17. The superconducting accelerating tube of claim 14, wherein the material of each of said half cells has a thickness in a range between 0.1 mm and 1 mm.

18. The superconducting accelerating tube of claim 9, wherein said superconductor material of said respective ring-shaped connecting member is Nb.

19. The superconducting accelerating tube of claim 9, wherein the large-diameter portion of each of said half cells has an inner diameter, and the material of each of said half cells has a thickness of not less than 1/800 of the inner diameter of the large-diameter portion thereof.

20. The superconducting accelerating tube of claim 9, wherein the material of each of said half cells has a thickness in a range between 0.1 mm and 1 mm.

* * * * *